United States Patent [19]

Clark et al.

[11] Patent Number: 5,011,337

[45] **Date of Patent: * Apr. 30, 1991**

[54] MINE ROOF EXPANSION ANCHOR SHELL AND LEAF

[75] Inventors: Carl A. Clark; Raymond L. Wright, both of New York, N.Y.

[73] Assignee: The Eastern Company, Naugatuck, Conn.

[ * ] Notice: The portion of the term of this patent subsequent to Apr. 3, 2007 has been disclaimed.

[21] Appl. No.: 334,723

[22] Filed: Apr. 7, 1989

Related U.S. Application Data

[62] Division of Ser. No. 264,050, Oct. 28, 1988, Pat. No. 4,913,593.

[51] Int. Cl.[5] ..... E21D 20/02

[52] U.S. Cl. ..... 405/261; 405/259; 411/51; 411/72

[58] Field of Search ..... 405/259, 260, 261; 411/51, 57, 50, 49, 63, 64, 65, 66, 82, 71, 72, 73

[56] References Cited

U.S. PATENT DOCUMENTS 4,534,679 8/1985 White et al. ..... 405/261

4,913,593 4/1990 Clark et al. ..... 405/260 X

*Primary Examiner*—Randolph A. Reese

*Assistant Examiner*—J. Russell McBee

*Attorney, Agent, or Firm*—Charles S. McGuire

[57] ABSTRACT

A one-piece, malleable iron, expansion shell, and a leaf of such shell, for use in an expansion to be installed in a relatively small (about 1") diameter bore hole with a conventional size (⅝") bolt. The expansion shell, and individual shell leaves have unique features contributing to the effectiveness of the anchor when used either with or without a resin grouting mixture. The slots or spaces between adjacent shell leaves include upper and lower portions, each of constant width, the lower portion being wider than the upper portion, whereby the leaves are narrower in the area where they are bent outwardly from the closed ring at the base than in the area where they are compressionally engaged between the plug and the hole wall. Upper portions of the inner leaf surfaces taper toward the shell axis and the side edges of such surfaces taper toward one another from the upper, free ends of the leaves toward the lower ends. A first group of gripping teeth or serrations on the outer leaf surfaces near the lower ends of the leaves are deeper than a second group outwardly adjacent the plug contact area.

35 Claims, 3 Drawing Sheets

MINE ROOF EXPANSION ANCHOR SHELL AND LEAF

This application is a division of copending application Ser. No. 264,050, filed Oct. 28, 1988 Now U.S. Pat. No. 4,913,593.

BACKGROUND OF THE INVENTION

The present invention relates to expansion anchors for securing rock bolts in drill holes in mine roofs or other rock formations, and more specifically to an expansion anchor, and elements thereof, having novel features particularly adapted for use in relatively small diameter drill holes, either with or without a resin bonding material, with a bolt or rod of diameter previously used with larger expansion anchors.

Expansion anchors have for many years been one of the more common means employed in the support and stabilization of mine roofs and similar rock formations. Such anchors include a radially expansible shell and a tapered nut, commonly termed a camming plug, threaded onto one end of a bolt which is inserted into a drill hole in the rock formation. The diameter of the expansion shell in the unexpanded condition is very close to that of the drill hole so that the shell will frictionally engage the hole wall and be restrained from rotation as the bolt is rotated, thereby moving the camming plug axially on the bolt threads and expanding the shell into tightly gripping engagement with the hole wall. The bolt is then tensioned to a desired degree by applying the required amount of torque, forcing the bolt head, or a washer carried thereon, against a bearing plate engaging the rock surface around the entrance to the drill hole.

Another widely used means of anchoring bolts or other elongated rods, such as steel reinforcing rods ("rebar") within drill holes are cement or resin materials which fill the annular space between at least a portion of the rod and the drill hole wall and harden to bond the rod to the rock. Such materials are available in the form of two-compartment cartridges containing a resin and a catalyst which are separated from one another until insertion of the cartridge into the drill hole, at which time the rod is advanced into the hole to rupture the cartridge, release the two components, and mix them together by rotation of the rod.

Bolt anchoring systems employing both mechanical expansion anchors and resin bonding have also been proposed in various forms. In past years the amount of mixing of the resin components which resulted from insertion of the bolt and rotation thereof only for the time required to expand a conventional mechanical anchor was insufficient to provide the desired fully hardened condition of the mixture. For this reason, a number of combined resin-mechanical anchoring systems have been devised to ensure that the full advantages of both types of anchorage are realized. These include, for example, special forms of packaging to permit pre-mixing of the components while using a conventional expansion anchor, such as in U.S. Pat. No. 3,474,898 to Montgomery, and means for delaying expansion of the shell to extend the time of bolt rotation, such as in U.S. Pat. No. 3,188,815 to Schuermann et al.

Resin systems available in two-compartment cartridges at the present time, such as that marketed by DuPont under the trademark Fasloc, do not require special provisions for mixing when used in combination with expansion anchors. That is, the components are sufficiently mixed by rupturing the cartridge and forcing the components out as the bolt is inserted, and by rotation of the bolt to set a conventional expansion anchor in the usual manner, i.e., with about 3–5 seconds of rotation.

Although roof bolt expansion anchors of steel have been employed in a number of designs, the vast majority of such anchors presently in use are made of malleable iron. One of the most popular designs of malleable iron expansion anchor includes a shell having four prongs or leaves extending integrally from a closed ring at one end to opposite, free ends, with an open space or slot between adjacent leaves. The small end of the tapered nut or camming plug is inserted in the opening defined by the free ends of the leaves and is threaded on the end of a bolt extending through the expansion shell. After insertion into the drill hole, the bolt is rotated to move the camming plug axially between the leaves, the latter thus being expanded radially from their free ends, and bent outwardly from their opposite ends which remain integrally attached to the ring. The shell and plug are maintained in assembled relation on the bolt prior to use either by a support nut threaded on the bolt under the shell or by a bail having end portions engaged with the shell and extending over the plug.

Prior art successful commercial forms of these so-called four-prong shells and associated camming plugs have been produced in embodiments 1¼" or more in outside diameter by conventional casting techniques. However, smaller anchors which are simply scaled-down versions of these conventional anchors do not operate properly. One problem stems from the fact that a bolt at least ⅝" in diameter must be used, regardless of the size of the expansion anchors, so that the desired amount of tension may be applied to the bolt upon installation. Thus, while the dimensions of the shell and plug must be smaller, the plug must still be tapped with internal threads of the same diameter as in the larger anchors. Also, the threaded length of the plug cannot be substantially reduced and still maintain the required length of engagement with the bolt threads. Other problems arise from the requirements of obtaining proper bending of the leaves as they expand, providing sufficient contact area of the leaf surfaces with the bore hole wall, preventing excessive elongation or destruction of the shell leaves due to extreme compressive forces upon full installation, and ensuring adequate flow of the resin components around and through the shell in systems which combine resin and mechanical anchoring.

Accordingly, it is a principal object of the present invention to provide a malleable iron mine roof expansion anchor of the four prong type for use in a combination mechanical-resin anchor system in drill holes on the order of 1" in diameter with a ⅝" bolt.

Another object is to provide a mine roof expansion anchor having a unique combination of dimensions and details of configuration which insure proper operation and anchorage capacity in a four prong anchor having a maximum outside diameter of 1" for use with a ⅝" bolt.

A further object is to provide a malleable iron mine roof expansion anchor for use in a drill hole slightly over 1" in diameter with a ⅝" bolt, and having dimensional and constructional features which insure proper operation and holding capacity when used both with and without supplementary resin anchoring.

Still another object is to provide a novel tapered camming plug for a mine roof expansion anchor having constructional features particularly useful in relatively small scale versions of such anchors, and when used in conjunction with resin anchoring.

A still further object is to provide a novel leaf configuration for incorporation in a four-prong malleable iron expansion anchor shell having a maximum external diameter of not more than 1" and properly operable with a roof bolt ⅝" in diameter.

Other objects will in part be obvious and will in part appear hereinafter.

SUMMARY OF THE INVENTION

The expansion anchor of the invention comprises a tapered camming plug and an expansion shell having four prongs or leaves, sometimes called fingers, extending from integral connections at one end with a ring-like base portion to terminal ends with slots or spaces between adjacent leaves extending from the ring to the terminal ends, having these features in common with prior expansion anchors 1¼" or more in diameter. The present anchor, however, has unique design features making it suitable for use in smaller drill holes, the anchor having a maximum external diameter of not more than 1" and a camming plug with internal threads tapped to receive a ⅝" bolt.

The plug has an axial length about one-half that of the shell, which is substantially the same as the relative lengths of the plug and shell of anchor assemblies for use in larger drill holes. However, the plug of the present invention has internal threads extending for its entire length, as opposed to larger plugs which typically have an upper, unthreaded portion extending a substantial distance past the threaded portion. A further distinction and important feature of the present design is the provision on the external surface of the plug of an axially extending rib which projects outwardly from the major diameter of the plug over the full length thereof. The plug design cooperates with the shell prong dimensions to provide optimum distribution of compression bearing forces as the shell is expanded.

The shell leaves, as previously stated, are separated from one another by spaces or slots extending axially from the closed ring at one end of the shell to the free ends of the leaves at the other end. The slots are of a first, substantially uniform width over a first, major portion of their axial length extending from the free ends of the leaves toward the ring, and are wider in a second portion adjacent the ring; thus, the leaves themselves are narrower over the second portion of their length, extending to their junction with the ring. The first and second (wider and narrower) portions meet at a shoulder on each side of the leaf. This provides two important advantages, namely, the leaves may bend outwardly from the ring more easily as the shell is expanded without sacrificing surface gripping area, and, when the expansion anchor is used with a resin cartridge, the resin components may flow more freely through the shell when released from the cartridge for mixing.

Still another important feature of the shell configuration is found in the design of the leaves, each of which includes an internal and an external surface, joined by two side surfaces, the latter having inner and outer edges at which the side surfaces meet the inner and outer surfaces, respectively. The internal and external surfaces lie on concentric circles in any single plane perpendicular to the shell axis. The internal surfaces are chamfered to taper inwardly toward the shell axis for a first axial portion of their length and taper inwardly at an angle less than that of the chamfered portion over a second axial portion. It is this second axial portion of the inner surface of the leaves which is compressionally contacted by the plug at full insertion thereof, i.e., when the shell is fully expanded in the installed condition of the anchor, the chamfered portion adjacent the free ends remaining out of contact with the plug due to the steeper taper angle.

The plug contact area of each leaf inner surface terminates at its lower end in an outwardly directed radius at a juncture with a third axial portion of the inner surface. This third portion lies on a circle of the same diameter as the inside diameter of the ring at the base of the anchor. The inner edges of the side surfaces of each leaf taper inwardly, toward one another, from the upper, free end of the leaf to the lower termination of the plug contact area. The outer edges of the side surfaces are parallel to one another over the full length of the leaves, being laterally spaced by a greater distance above the shoulders on each side of the leaf than below. The external surfaces of the leaves are formed with a plurality of parallel, circumferentially extending stepped serrations or gripping teeth in both the first and second portions of the fingers, the depth of the teeth being greater in the second, narrower portions of the leaves than in the first, wider portions. The foregoing and other design features of the expansion anchor assembly are described and explained more fully in the following detailed description and will be more readily appreciated with reference to the accompanying drawings.

DETAILED DESCRIPTION

Figure 1:
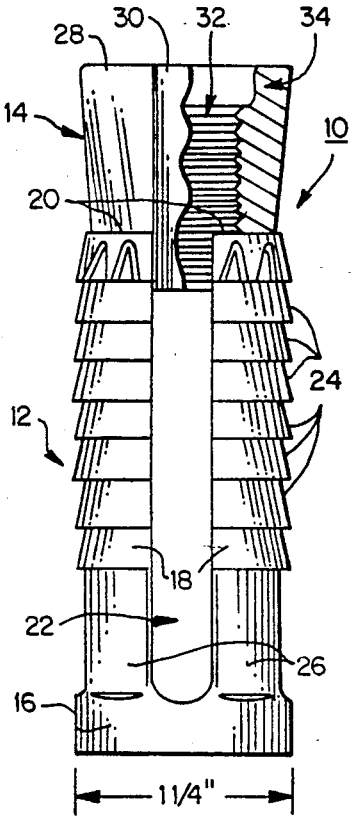
FIG. 1 PRIOR ART
FIG. 1 is a front elevational view of a typical four prong shell and associated camming plug of the prior art, the plug being shown in half section.

Referring now to the drawings, in FIG. 1 is shown a typical mine roof expansion anchor assembly of prior art design, designated generally by reference numeral 10, and including a so-called four prong expansion shell 12 and tapered camming plug 14. Anchor assemblies of this type have been fabricated from malleable iron for many years for use in drill holes 1¼" or 1⅜" in diameter. The maximum transverse dimension of the anchor assembly, i.e., the diameter of the shell, is essentially equal to the drill hole diameter so that the assembly may be inserted into the drill hole without substantial interference, yet will frictionally engage the bore hole wall to inhibit rotation of the assembly when the associated bolt is rotated.

Shell 12 and plug 14, as well as the shell and plug of the anchor shown in subsequent Figures, are oriented as they normally would be when installed in a vertical drill hole in a mine roof. Therefore, the references herein to upper and lower, or top and bottom, ends of the parts pertains to the elements in their illustrated orientations.

The lower end of shell 12 is formed by continuous, closed ring 16 and the four prongs or leaves of the shell, two of which are seen in FIG. 1 and denoted by reference numeral 18, extend integrally from ring 16 to upper, free ends 20. Each of leaves 18 is spaced from the adjacent leaves on each side by a space or slot 22 which extends from the lower ends of leaves 18, at their respective junctures with ring 16, to free ends 20. Slots 22 are of essentially uniform width throughout their length, whereby the leaves are also of uniform, arcuate width.

Each of leaves 18 is formed with serrations 24 on its outer surface in evenly spaced relation from free ends 20 to provide a gripping surface for engagement with the bore hole wall. Lower portions 26 of the leaves do not include such serrations since they are not intended to contact the bore hole wall. The inner leaf surfaces (not shown) are smooth and taper inwardly toward the shell axis from free ends 20 to the lower ends of the fingers.

Camming plug 14 is formed with four sides or faces 28, separated by grooves 30. Plug 14 tapers outwardly from the lower to the upper end at a predetermined angle. Some prior art anchors of this type include a metal strap or bail (not shown) having a medial portion extending over the top of the plug and legs passing downwardly through two of the grooves 30 and slots 22 between leaves 18 on opposite sides of the anchor; outwardly bent portions at the bottom of each leg are engaged under ring 16 to prevent separation of the plug and shell. Plug 14 is cast with a central bore 32 which is drilled and tapped to accept, e.g., a ⅝" bolt for a length of approximately ⅞". Lip portion 34, including portions of faces 28, extends upwardly from the portion of the plug surrounding the upper end of bore 32 for a length typically ranging from ⅜" to 1", depending on the desired overall length of the plug. For a more detailed description of a relatively recent design of four prong shell and plug, suitable for use with a conventional resin cartridge, see U.S. Pat. No. 4,764,055, issued Aug. 16, 1988.

Figure 2:
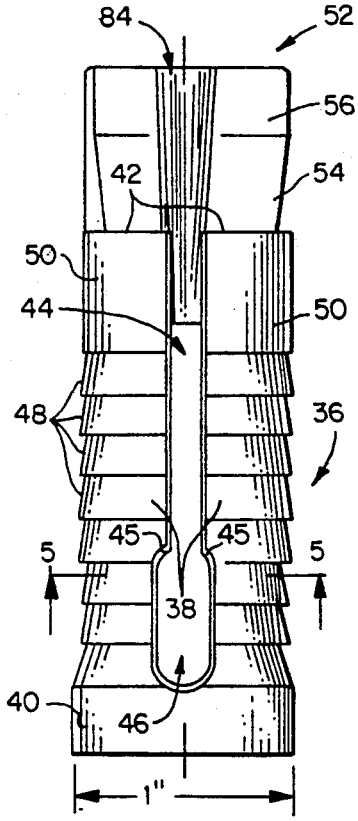
FIG. 2 is a front elevational view of the preferred embodiment of the four prong shell and camming plug forming the expansion anchor assembly of the present invention.
Figure 3:
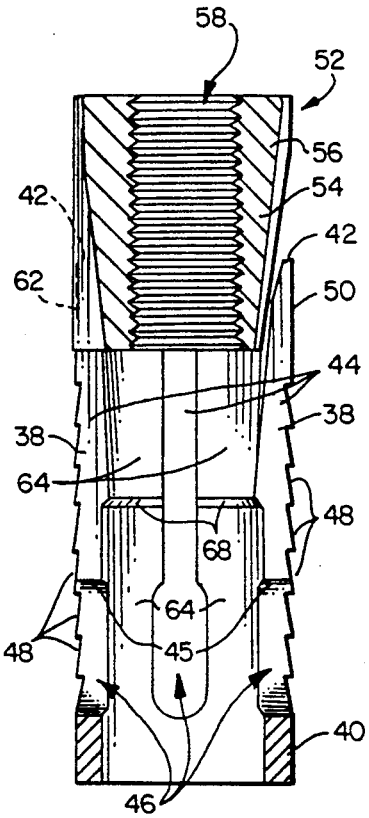
FIG. 3 is a front elevational view of the shell and plug of FIG. 2 in vertical section.
Figure 4:
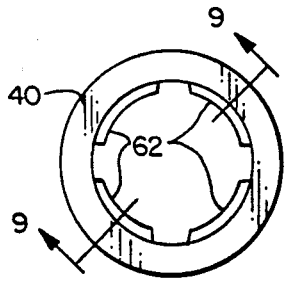
FIG. 4 is a bottom plan view of the shell of FIG. 2.
Figure 5:
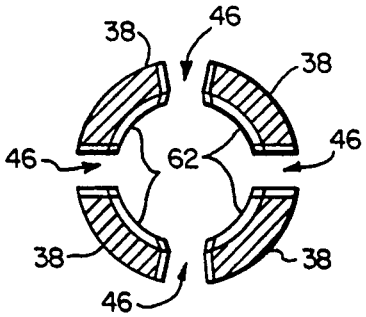
FIG. 5 is a plan view of the shell of FIG. 2 in section on the line 5—5 thereof.

Turning now to FIGS. 2–13, an expansion anchor assembly of the same general configuration as the prior art anchor of FIG. 1, constructed in accordance with the teachings of the present invention, will be described. Although the anchor assembly of FIGS. 2 and 3 is shown as the same size as that of FIG. 1 for easier comparison of physical features, it will be understood that the anchor of the present invention is of smaller diameter, as indicated by the dimensions shown under FIGS. 1 and 2.

Shell 36 includes four prongs or leaves 38 extending from integral connections with ring 40 at their lower ends to upper, free ends 42. Leaves 38 are separated from the leaves on each side by spaces or slots having upper portions 44 of substantially uniform width extending downwardly from free ends 42 for a portion of the length of the leaves, and widened lower portions 46 extending between ring 40 and the lower ends of upper slot portions 44. Thus, the circumferential extent of leaves 38 is less at the juncture thereof with ring 40, i.e., at the lower ends, than it is at the upper ends. Upper and lower slot portions 44 and 46, respectively, meet at shoulders 45 on each side of leaves 38.

Evenly spaced serrations or teeth 48 extend about the outer surfaces of leaves 38 from the juncture thereof with ring 40 to upper portion 50, which comprises about one-quarter of the total leaf length and has no serrations. The serrations are of the same general configuration as those of prior four-prong expansion shells, each comprising a radial step or lip extending the full lateral width of the external leaf surface, each step being joined to the next by a surface which slopes outwardly, away from the longitudinal axis of the leaf and shell, toward the lower end of the leaf and shell. In prior four-prong shells the serrations typically extend in evenly spaced relation from the upper, free end of each leaf for a major portion of the leaf length, with an area adjacent the lower ends of the leaves having no serrations, as in the shell of FIG. 1. The present shell, on the other hand, includes evenly spaced serrations extending from the lower ends of the leaves for a major portion of the leaf length, with an area adjacent the upper, free ends having no serrations.

In addition to the difference, in positioning of the serrations, the depth of a first plurality of serrations, including and extending successively from the lowest serration, is greater than the depth of the remaining plurality of serrations of the present shell leaves. For example, the radial depth of the steps or lips of the lower three serrations, indicated in FIG. 9 by reference numeral 48', may be twice as great (e.g., 0.03") as the depth of the steps of the upper five serrations (0.015"). The axial height of the serrations, measured parallel to the leaf and shell areas, may be, e.g., 0.1875" in a shell having an overall axial length of 2⅜". Prior art four-prong shells for use in 1¼" drill holes with ⅝" bolts typically have a length of 3" or more. The smaller diameter and axial length of the present shell require smaller radial sections, i.e., thinner leaves. The likelihood of shell failure (cracking or breaking) when the leaves are under maximum compression is minimized by making the depth of the serrations smaller in that portion of the outer leaf surfaces opposite the inner surfaces which are contacted by plug surfaces when the shell is fully expanded.

Camming plug 52 includes lower and upper, conical, external surfaces 54 and 56, respectively. Plug 52 tapers outwardly from its lower to its upper end at a first angle of about 7° in lower portion 54, and at a second angle of less than 3°, preferably about 1°, in upper portion 56. Central bore 58 extends through plug 52 and, as seen in the sectional view of FIG. 3, is threaded for its entire length between the upper and lower ends of the plug.

Figure 6:
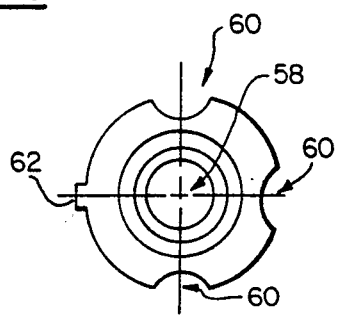
FIG. 6 is a top plan view of the camming plug of the invention.
Figure 7:
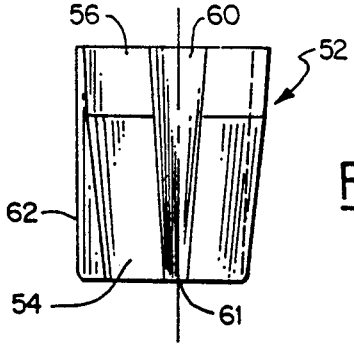
FIG. 7 is a front elevational view of the plug of FIG. 6.
Figure 8:
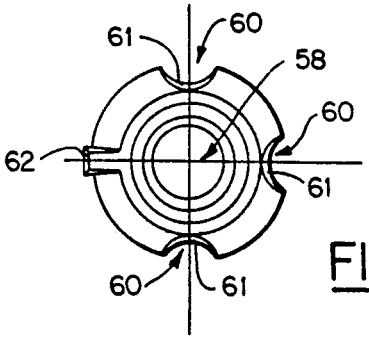
FIG. 8 is a bottom plan view of the plug.

External details of plug 52 are best seen with reference to FIGS. 6–8. Axially extending, curved indentations or scalloped areas 60 are formed at three places, spaced by 90° from one another, in the external surface of the plug. As seen in FIG. 7, scalloped areas 60 are wider at the top than at the bottom. Also, rather than tapering at two different angles as the external plug surfaces, scalloped areas 60 taper outwardly from the lower to the upper end of plug 52 at a constant draft angle of, e.g., 1½°. The depth of scalloped areas 60 at the upper end of the plug is such that the depth at the lower end is essentially zero, i.e., the scalloped areas blend with the outer surface of the plug at the lower end at the points denoted by reference numeral 61 in FIGS. 7 and 8.

Rib 62 extends radially outwardly from the surface of plug 52 at a position spaced 90° from two adjacent scalloped areas. It is important to note that rib 62 extends outwardly from the surface of plug 52 along the full axial length thereof, including the largest diameter portion at the upper end of the plug, differing in this respect from prior art camming plugs. This has been found to provide significant operational improvement in expansion anchors of this type, particularly in applications where the anchor is used in conjunction with a resin bonding material, as described later herein. In the preferred form of anchor, having a nominal 1" diameter, the maximum outside diameter of shell 36 (at both the upper and lower ends) is 0.984"+ 0.002", and the plug major diameter at the top is 0.97". Rib 62 extends outwardly from the outer surface of the plug 0.03" at the top and 0.125" at the bottom, having a slight draft or taper angle of less than 1° along its outer edge. This means that the radius from the center of the plug to the outer edge of rib 62 is 0.515" at the top of the plug and 0.5" at the bottom.

Portions 64 of the internal surfaces of leaves 38 are conical, tapering axially inwardly toward the lower end of shell 36 at an angle of about 4°, whereby the fingers increase in thickness from the upper to the lower ends of portions 64. Chamfered internal surface portions 66 are provided adjacent free ends 42, tapering at a steeper angle to the shell axis than portions 64. The axial length of portions 66 is preferably about 1/5 that of portion 64, the total axial length of the tapered portions 64 and 66 being slightly less than half the overall length of shell 36. Tapered portions 64 extend from chamfered portions 66 to steps or transition areas 68, which merge the tapered portions with lower internal surface portions 70 of the same diameter as the inside of ring 40.

In addition to the inner and outer surfaces, each of leaves 38 includes side surfaces 71 which meet the inner and outer surfaces along inner and outer edges 73 and 75, respectively. The side surfaces of the leaves taper radially inwardly from the outer to the inner surfaces, i.e., the outer surface is wider than the inner surface at any radial plane, as may be seen in the sectional view of FIG. 5. As also seen in this Figure, side surfaces 71 on opposite sides of two of slots 44–46 are parallel to one another while portions of the side surfaces on opposite sides of the other slots are not parallel. This is due to the fact that the slots on two opposite sides (those with parallel edges) are cored slots while those on the other two sides are green sand slots having a parting line with a draft angle on one side, in accordance with standard malleable iron casting practices.

Inner edges 73 on each side of the leaf inner surfaces taper inwardly, toward one another, from top to bottom over the axial lengths of inner surface portions 64 and 66, i.e., the internal surfaces of the leaves are narrower at the bottom than at the top of portions 64 and 66. Thus, the minimum internal diameter of shell 12 is at shoulders 68, and is only slightly larger (e.g., 0.03") than the ⅝" diameter of the bolt which extends through the shell and plug. Steps 68 are slightly above the horizontal centerline of shell 12, e.g., the internal taper on the leaves, including both portions 64 and 66, may extend axially for a distance of 1.115" from free ends 42 to shoulders 68 in a shell having an axial length of 2.375".

Figure 10:
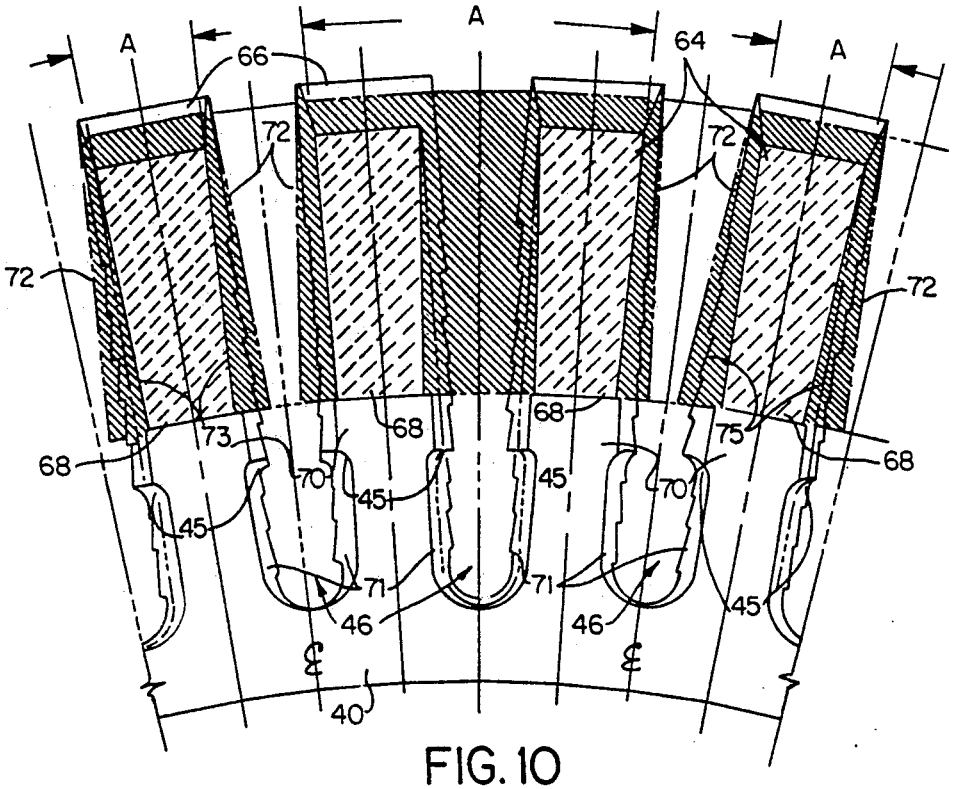
FIG. 10 is an elevational view of the inside of the shell, shown as it would appear if opened to a flat configuration and cross-hatched to indicate the superposed surfaces of the plug when fully engaged.
Figure 9:
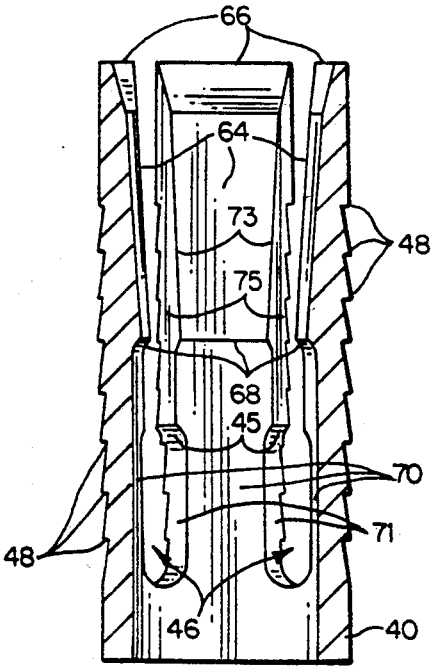
FIG. 9 is an elevational view of the shell in section on the line 9—9 of FIG. 4.

FIG. 10 shows the interior of shell 36 as it would appear if cut through ring 40 along the centerline of one of lower slot portions 46 and expanded to a flat condition. The shell does not appear in this manner in any stage of manufacture or use, of course, although the drawing in this form is useful in illustrating the internal configuration of the shell. Also, the figure is shaded in dashed lines to show the areas where shell and plug surfaces are in mutual engagement, and in solid lines to show the position of external plug surfaces which oppose but do not contact shell surfaces, upon full insertion of the plug into the shell, i.e., at maximum anchor expansion. It will be noted that plug and shell surfaces are in contact over the full areas of shell surface portions 64, from side to side, and top (at the juncture with chamfered portions 66) to bottom (at shoulders 68). External plug surfaces other than in scalloped areas 60 oppose, but do not contact, portions of chamfered areas 66, side edges 71, and extend into upper slot portions 44. The lines laterally bordering the shaded areas and indicated in FIG. 10 by reference numeral 72 indicate the edges of scalloped areas 60. Thus, outer plug surfaces, including that of rib 62, oppose the shell fingers and slots therebetween, in either contacting or spaced relation, in the shaded areas between lines 72 having a lateral extent indicated by dimension lines "A" in FIG. 10.

Figure 11:
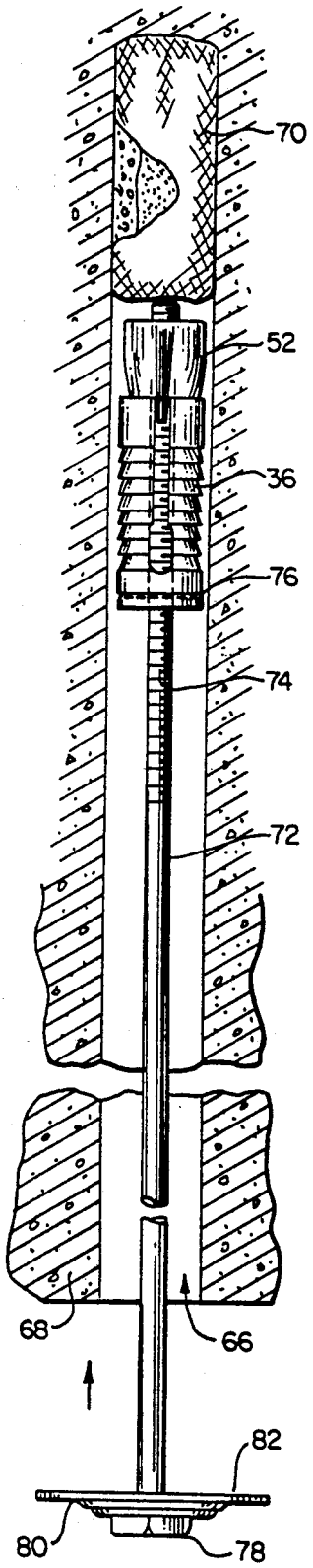
FIG. 11 is an elevational view of the expansion anchor of the invention, shown with an associated bolt, support plate and resin cartridge during an initial stage of installation in a drill hole in a rock formation, the latter being shown in section.
Figure 12:
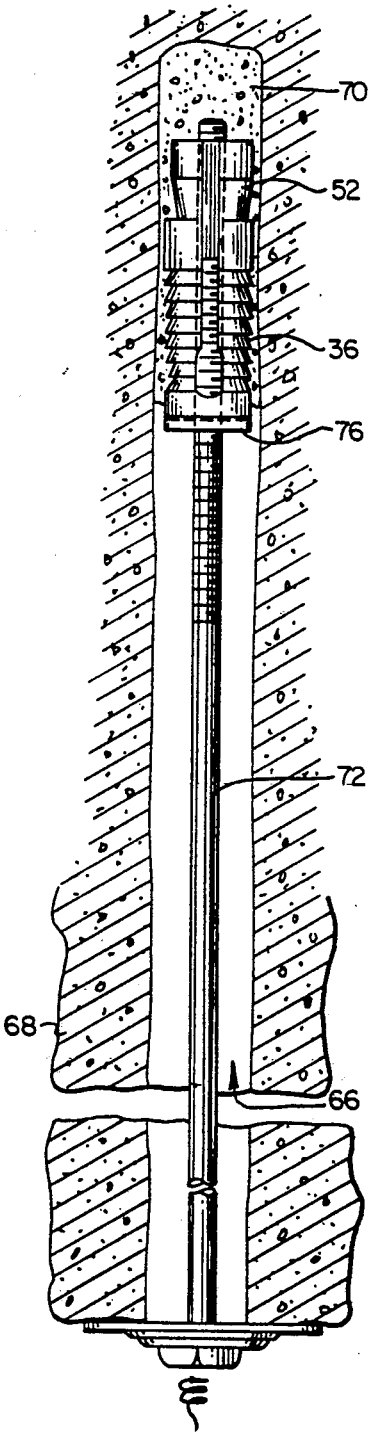
FIG. 12 is an elevational view of the elements of FIG. 11, shown in an intermediate stage of installation.
Figure 13:
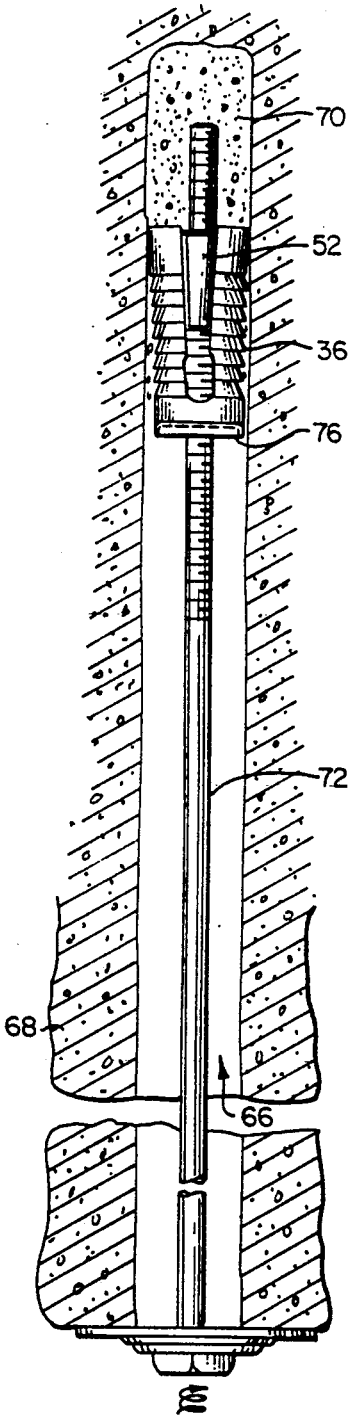
FIG. 13 is an elevational view, as in FIGS. 11 and 12, showing the anchor fully installed.

The manner of installation of the anchor of the invention with a conventional resin cartridge is shown in FIGS. 11–13. Drill hole 74 is formed in rock formation 68 such as a mine roof, to a diameter of 1 1/32" and a predetermined depth an inch or two longer than the bolt to be used. Cartridge 78, having a diameter approximating that of drill hole 74, is placed into the drill hole, followed by bolt 80, having a diameter of ⅝". Threads 81 on bolt 80 are engaged with the internally threaded bore 58 of plug 52 and shell 36 is supported by conventional Palnut 82. Head 84 is formed on the opposite end of bolt 80 and carries washer 86 and bearing plate 88 in the usual manner.

In the FIG. 11 position, head 84 of bolt 80 is engaged by a wrench on the end of a hydraulically powered arm on a roof bolting machine, and the arm is moved upwardly. Cartridge 78 is fractured and the resin and catalyst are released from the separate compartments in which they are initially contained to flow around the threaded end of bolt 80, as shown in FIG. 12. Since the upper end of shell 36 is essentially filled by plug 52, the resin components must enter the annular space between the threaded end of the bolt and the inside surfaces of the shell through slot portions 44 and 46. Also, since the outside diameters of plug 52 and shell 36 are only slightly smaller, e.g., about 0.02" and 0.03", respectively, than the diameter of drill hole 74, scalloped areas 60 on three sides of plug 52 permit such flow. Scalloped areas 60 are aligned with slot portions 44 and thus provide channels guiding the resin components into the slots and the annular space inside the shell. Enlarged slot portions 46 enhance the flow of resin components through shell 36.

When insertion of bolt 80 is complete, as in FIG. 12, rotation is imparted to bolt 80 by the wrench engaged with bolt head 84. Although there may be a slight amount of slippage of shell 36 on the wall of drill hole 66 when bolt rotation commences, there is essentially no rotation of shell 36 by plug 52. Rotation of bolt 80 causes plug 52 to travel down threads 81, expanding the shell fingers outwardly into tight engagement with the wall of drill hole 74, permitting a desired tension to be applied to bolt 80. Also, bolt rotation for the few seconds required to expand the shell and tension the bolt, together with the mixing action provided by forcing the initially liquid components through the small space between the anchor and the hole wall and through the shell slots, serves to mix the resin components sufficiently to cause the mixture to harden about the upper end of the bolt. The anchor may be installed in the same manner without a resin cartridge in installations where only a mechanical anchorage is required.

As initially stated, the invention is intended to provide an anchor of substantially smaller dimensions than those of the prior art with a bolt of conventional dimensions, an object which cannot be accomplished simply by scaling down the dimensions of larger, prior art anchors. One problem which must be overcome in order for a smaller scale anchor to function properly is excessive elongation of the shell fingers, often to the point of destruction, when compressed between the plug and the drill hole wall. That is, when the required amount of tension, is applied to a ⅝" bolt, the force which is transmitted outwardly to the shell fingers by the plug may be in excess of that which the malleable iron leaves of a smaller shell can withstand.

This problem is overcome in the anchor of the present invention by a combination of structural features properly relating configuration and relative dimensions of the plug and shell. Such features, operating individually and collectively to provide an operational four-prong expansion anchor of the desired size, i.e., a maximum diameter of not more than one inch and an axial shell length of 2⅜", include the following:

1. shell leaves which are narrower in a lower portion, where the fingers are bent outwardly from the connecting ring, than in the upper, wall-contacting portion;

2. internal leaf surfaces which taper inwardly toward the shell axis from the upper, free ends of the fingers for a portion of the shell length, terminating in steps or shoulders merging the tapered portions with lower finger portions of uniform thickness, the tapered portions further having side edges converging inwardly toward the lower end, whereby the leaf surfaces contacted by the plug are narrower and the leaves are thicker at the upper ends thereof;

3. shell leaves having outer surfaces with an evenly spaced succession of serrations extending from the lower ends of the leaves, the serrations at the lower end being deeper than those at the upper end;

4. a camming plug having an axial length approximately one-half that of the shell and internal threads over substantially its entire length;

5. a camming plug having an external rib projecting outwardly from the plug outer surface over the entire axial length of the plug; and 6. a camming plug and shell having a combination of contacting and non-contacting surfaces and shell finger widths and thickness permitting full tensioning of a ⅝" bolt in an anchor having a maximum, unexpanded diameter of not greater than one inch.

What is claimed is:

1. A one-piece expansion shell for use with a tapered camming plug in a blind drill hole in a rock formation to anchor therein an elongated mine roof bolt having an externally threaded end portion engaged with an internally threaded opening in said plug, said drill hole having a diameter of about 1" and said roof bolt having a nominal diameter of ⅝" said expansion shell comprising:

(a) a ring-like base portion of substantially uniform thickness having inner and outer diameters, concentrically arranged about a central axis;

(b) four leaf portions extending integrally from said base portion in a common direction and concentrically arranged about said central axis, each of said leaf portions having inner, outer and side surfaces and terminal ends lying in a common plane perpendicular to said central axis;

(c) said leaf portions being laterally spaced from one another about said central axis by elongated slots extending from said base portion to said terminal ends along centerlines parallel to said central axis and bounded on each side by said side surfaces of adjacent leaf portions;

(d) each of said slots having first and second contiguous portions, said first portion extending from said base portion to the juncture with said second portion and said second portion extending from the junction with said first portion. to said common plane;

(e) said first portion of each of said slots having a first, substantially constant width and said second portion of each of said slots having a second, substantially constant width less than said first width, whereby said leaf portions are narrower over the length thereof bordered by said first slot portions than over the length bordered by said second slot portions;

(f) said inner surfaces including at least first and second distinct sections extending axially of said leaf portions, said first section tapering inwardly from said terminal ends toward said central axis to a termination defining a minimum inside diameter of said shell, and said second section extending from a juncture with said first section to said base portion substantially parallel to said central axis; and (g) a stepped shoulder and radius defining the juncture of said first and second inner surface sections and the transition from said minimum inside diameter to a larger, constant diameter over the axial length of said second section, said stepped shoulder on each of said leaf portions lying in a plane perpendicular to said central axis and intersecting said second slot portions.

2. The expansion shell of claim 1 wherein said second width is about ⅝ of said first width.

3. The expansion shell of claim 1 wherein the axial length of said first slot portions is less than one-half the axial length of said second slot portions.

4. The expansion shell of claim 1 wherein said leaf inner surfaces taper from said terminal ends conically inwardly over a first portion of the axial length of said leaf portions and extend substantially parallel with said central axis over a second portion of said leaf axial length from a shoulder at the juncture of said first and second portions to the juncture of said leaf portions with said base portion.

5. The expansion shell of claim 4 wherein said first inner surface portions have an axial length more than twice that of said second inner surface portions.

6. The expansion shell of claim 5 wherein said first inner surface portions taper inwardly at a steeper angle in a first region adjacent said terminal ends than in a second region, extending from the juncture of said first and second regions to said shoulder.

7. The expansion shell of claim 6 wherein said first region extends axially a distance less than ¼ the axial length of said second region.

8. The expansion shell of claim 5 wherein said first and second regions taper inwardly with respect to said central axis at angles of about 7° and 4°, respectively.

9. The expansion shell of claim 1 wherein said leaf portion outer surfaces include a plurality of angled serrations extending circumferentially about each of said outer surfaces from the juncture thereof with said base portion for at least a portion of the axial length of said leaf portions.

10. The expansion shell of claim 9 wherein said serrations comprise a succession of stepped shoulders lying in planes transverse to said central axis and joined by surfaces tapering inwardly toward said terminal ends, said serrations extending substantially from the juncture of said leaf portions with said base portion at equally spaced intervals.

11. The expansion shell of claim 10 wherein said stepped shoulders of a first, successive plurality of said serrations adjacent said base portion have a radial depth greater than the radial depth of said stepped shoulders of a second, successive plurality of said serrations extending from said first plurality to the termination of said serrations.

12. The expansion shell of claim 11 wherein said serrations extend successively from said juncture of said leaf portions with said base portion over a first region of said leaf portion outer surfaces, and a second region of said leaf portion outer surfaces, extending from said first region to said terminal ends is substantially smooth and axially parallel with said central axis.

13. The expansion shell of claim 12 wherein the axial length of said first region is about 3 times that of said second region.

14. The expansion shell of claim 11 wherein the number of said serrations of said first plurality is less than the number of said second plurality.

15. A mine roof expansion anchor leaf of malleable iron having a lower end integrally attached to a ring-like base portion of an expansion anchor, and extending along an axis from said lower end to an upper end, said leaf comprising:

(a) an inner, an outer and two side surfaces, said side surfaces each having an inner edge at which said side surfaces meet said inner surface, and an outer edge at which said side surfaces meet said outer surface;

(b) said inner surface including a first portion extending from said upper end for a first axial distance, and a second portion extending from a juncture with said first portion to said lower end;

(c) said outer surface including a plurality of serrations formed as a substantially evenly spaced succession of steps lying in substantially evenly spaced, parallel planes extending laterally for the full width of said outer surface and joined by surface portions sloping outwardly toward said lower end, said serrations extending from said lower end for at least ⅔ of the distance to said upper end; and (d) a first succession of said steps beginning at said lower end having a radial depth greater than the radial depth of a second succession of said steps extending from said first succession toward said upper end of said leaf.

16. The mine roof anchor leaf of claim 15 wherein said inner and outer surfaces lie on spaced, concentric circles in any single plane perpendicular to said leaf axis.

17. The mine roof anchor leaf of claim 16 wherein said first portion of said inner surface tapers away from said outer surface from said upper toward said lower end, whereby said leaf becomes progressively thicker from said upper toward said lower end over said first portion of said inner surface.

18. The mine roof anchor leaf of claim 17 wherein said first portion of said inner surface includes upper and lower regions, respectively sloping sway from said outer surface at first and second distinct angles, said first angle being greater than said second angle.

19. The mine roof anchor leaf of claim 18 wherein said first and second angles are about 7° and 4°, respectively.

20. The mine roof anchor leaf of claim 18 wherein said upper region extends axially of said leaf for not more than about 1/5 the axial extent of said lower region, said upper region extending from said upper end of said leaf to said lower region and said lower region extending from said upper region to said juncture of said first and second portions of said inner surface.

21. The mine roof anchor leaf of claim 18 wherein said second portion of said inner surface extends from said juncture with said first portion to said lower end in a plane substantially parallel with said leaf axis.

22. The mine roof anchor leaf of claim 16 wherein said inner edges of said side surfaces taper inwardly, toward one another, from said upper end toward said lower end of said leaf, over said first portion of said inner surface, whereby said inner surface becomes progressively narrower from said upper end to said juncture of said first and second inner surface portions.

23. The mine roof anchor leaf of claim 22 wherein said outer edges of said side surfaces are substantially parallel to one another over the full length of said leaf and are spaced from one another by first and second lateral widths over respective first and second axial areas, said first axial area extending longitudinally from said upper end to said second axial area, and said second axial area extending longitudinally from said first axial area to said lower end, said first lateral width being greater than said second lateral width.

24. The mine roof anchor leaf of claim 23 wherein said first axial area extends longitudinally at least twice the length of said second axial area.

25. A malleable iron leaf of a mine roof expansion anchor, said leaf extending from a lower end integrally connected to a ring-like base portion of said anchor to an upper end along a longitudinal axis, said leaf comprising:

(a) inner and outer surfaces lying on spaced, concentric circles in any single plane perpendicular to said longitudinal axis;

(b) two side surfaces each having inner and outer edges at which said side surfaces meet said inner and outer surfaces, respectively;

(c) said outer edges being substantially parallel to one another over the full length of said leaf, and spaced from one another by first and second lateral distances over respective first and second axial portions of said leaf, said first distance being greater than said second distance, said first axial portion extending from said upper end to a shoulder on each side of said leaf, and said second axial portion extending from said shoulder on each side of said leaf to said lower end, said second axial portion being narrower than said first axial portion;

(d) said inner edges tapering inwardly toward one another over an upper region extending from said upper end to a transition area and extending substantially parallel to one another and to said outer edges over a lower region extending from said transition area to said lower end; and (e) said inner surface tapering away from said outer surface from said upper end to said transition area, whereby said leaf becomes progressively thicker from said upper end toward said lower end over said upper region, and said inner surface lies in a plane substantially concentric to said longitudinal axis over said lower region, said shoulders being closer than said transition area to said lower end.

26. The leaf of claim 25 wherein the axial length of said upper region is greater than the axial length of said lower region.

27. The leaf of claim 26 wherein the axial length of said first axial portion is at least twice the axial length of said second axial portion.

28. The leaf of claim 27 wherein said outer surface includes a plurality of serrations formed as a substantially evenly spaced steps extending laterally for the full width of said outer surface between said side surfaces outer edges, and joined by surface portions sloping outwardly toward said lower end.

29. The leaf of claim 28 wherein said serrations extend from said lower end for a portion of the distance to said upper end, an upper area of said outer surface being substantially smooth and free of said serrations.

30. A radially expansible, one-piece expansion shell symmetrically formed about a central, longitudinal axis for use with a tapered camming plug to anchor a mine roof bolt having a nominal diameter of $\frac{5}{8}''$ in a drill hole having a diameter of about 1", said assembly comprising:

(a) a continuous, ring-like base portion at the lower end of said shell, and four expansion leaf portions extending integrally from said base portion to terminal ends lying in a common plane perpendicular to said central axis and defining the upper end of said shell, said leaf portions being laterally separated by open slots extending axially from said base portion to said upper end of said shell; and (b) each of said leaf portions including:

(i) an outer surface formed in a succession of radially stepped serrations of substantially equal axial extent beginning at said base portion and extending for at least $\frac{2}{3}$ of the distance to said terminal ends, the outermost extent of each of said serrations being substantially equally spaced from said central axis;

(ii) an inner surface having a first region extending downwardly from said terminal end and tapering inwardly toward said central axis at a first angle, a second region extending downwardly from said first region to an outwardly stepped shoulder and tapering inwardly toward said central axis at a second angle, less than said first angle, and a third region extending downwardly from said stepped shoulder and substantially parallel to said central axis to said base portion; and (iii) two side surfaces joining said outer and inner surfaces, said side surfaces each joining said outer surface along outer lines extending downwardly from said terminal end substantially parallel to said central axis at least to a position adjacent said stepped shoulder, said side surfaces each joining said inner surface along inner lines extending downwardly from said terminal end converging inwardly toward one another at least to said stepped shoulder, whereby said inner surface is narrower at said stepped shoulder than at said terminal end and said leaf is thicker at said stepped shoulder than at any other axial position.

31. The expansion shell of claim 30 wherein said open slots are each symmetrically formed on opposite sides of an axis parallel to said central axis, and each include a first, wider portion extending upwardly from said base portion and a second, narrower portion extending from said wider portion to said terminal end, the axial length of said wider portion being less than the axial length of said third region of said leaf inner surface, whereby the juncture of said wider and narrower slot portions is closer to said base portion than said stepped shoulder.

32. The expansion shell of claim 31 wherein the axial length of said wider slot portions is less than one-half the axial length of said narrower slot portions.

33. The expansion shell of claim 32 wherein the width of said narrower portions is about $\frac{5}{8}$ of the width of said wider portions.

34. The expansion shell of claim 33 wherein the axial length of said first region is less than $\frac{1}{4}$ that of said second region.

35. The expansion shell of claim 30 wherein the axial length of said third region is about $\frac{3}{4}$ that of said second region.

* * * * *